United States Patent [19]

Morris et al.

[11] 4,098,864

[45] Jul. 4, 1978

[54] STEAM DRAWING OF POLYESTER MONOFILAMENT TO IMPROVE LOOP STRENGTH AND RESISTANCE TO FIBRILLATION

[75] Inventors: William E. Morris, Barranquilla, Columbia; Charles Jay Nelson, Munroe Falls, Ohio

[73] Assignee: The Firestone Tire & Rubber Company, Akron, Ohio

[21] Appl. No.: 785,373

[22] Filed: Apr. 7, 1977

Related U.S. Application Data

[63] Continuation-in-part of Ser. No. 658,960, Feb. 18, 1976, abandoned, which is a continuation-in-part of Ser. No. 588,764, Jun. 20, 1975, abandoned, which is a continuation of Ser. No. 345,621, Mar. 28, 1973, abandoned.

[51] Int. Cl.[2] ..... B29C 17/02

[52] U.S. Cl. ..... 264/290 T; 264/DIG. 28

[58] Field of Search ..... 264/290 T, 210 F, DIG. 73, 264/DIG. 28

[56] References Cited

U.S. PATENT DOCUMENTS

| | | | |
|---|---|---|---|
| 2,615,784 | 10/1952 | McClellan | 264/290 T |
| 2,664,009 | 12/1953 | Emerson | 264/DIG. 28 |
| 2,934,400 | 4/1960 | Siggel et al. | 264/210 F |
| 3,452,132 | 6/1969 | Pitzl | 264/210 F |

FOREIGN PATENT DOCUMENTS

| | | | |
|---|---|---|---|
| 47-9224 | 3/1972 | Japan | 264/290 T |
| 758,398 | 10/1956 | United Kingdom | 264/290 T |
| 1,266,982 | 3/1972 | United Kingdom | 264/290 T |

*Primary Examiner*—James B. Lowe

[57] ABSTRACT

There is provided a method of improving the properties of polyester monofilaments in respect to loop strength and resistance to fibrillation. The process contemplates treating an undrawn substantially noncrystalline extensible spun linear polyethylene terephthalate monofilament with a vapor medium such as steam and, while the monofilament is exposed to such vapor, drawing the monofilament at a draw ratio of from 1.5:1 to 4:1 and further drawing the monofilament in a subsequent drawing operation to an aggregate draw ratio of from 4:1 to 10:1.

The process enables development of the maximum or a desired loop strength value for the particular monofilament being processed with optimization of specific drawing conditions such as the steam pressure within the indicated draw ratios. Thus, drawn monofilaments having loop strength values of at least 2.5 grams/denier are provided, and the drawn products are particularly useful as reinforcing elements in rubber bodies, e.g. tire cords.

11 Claims, 5 Drawing Figures

STEAM DRAWING OF POLYESTER MONOFILAMENT TO IMPROVE LOOP STRENGTH AND RESISTANCE TO FIBRILLATION

BACKGROUND OF THE INVENTION AND PRIOR ART

This application is a continuation-in-part of applicants' copending application Ser. No. 658,960, filed Feb. 18, 1976, now abandoned which in turn is a continuation-in-part of applicants' copending application Ser. No. 588,764, filed June 20, 1975, now abandoned, which is a continuation of Ser. No. 345,621, filed Mar. 28, 1973, now abandoned.

The present invention relates to a process of treating polyester monofilaments with a vapor medium while drawing the monofilaments to improve loop strength and resistance to fibrillation, these properties being of particular significance in tire cord material where better flex life and tire life is the result of improvements in these properties. The process of the present invention has been found to be exceptionally effective in enhancing the physical properties of high denier monofilaments which have been heretofore sparingly and/or inefficiently utilized by the prior art in the absence of techniques to develop their optimum crystalline and strength characteristics. In addition to improving the loop strength and fibrillation resistance of such high denier monofilaments, significant improvement in the longitudinal tenacity values has been obtained which is believed to be a result of an increase in the effective draw ratio.

The fibrillation property with which the present invention is concerned is physically characterized by the occurrence of an irregular fracture line or "splintered-type" break upon tensile failure of a monofilament, especially a moderate denier filament. In a flex or fatigue failure, fibrillation may be observed as an initial, partial fracture about the periphery of a monofilament which is rapidly followed by complete failure of the monofilament. The improved resistance to fibrillation has been experimentally related to improved loop tenacity values and increased values of the ratio of loop tenacity to longitudinal tenacity.

So far as I am aware, the prior art has failed to appreciate the improved physical properties imparted to a polyethylene terephthalate monofilament by an initial draw of the monofilament while it is being contacted with a vapor medium in accordance with the teachings of the present invention. Further, the prior art has failed to appreciate the unique effects of a liquid vapor such as live steam containing entrained droplet-type liquid on an amorphous polyethylene terephthalate monofilament.

In contrast with the teachings of the present invention, the prior art has apparently only utilized steam in polyethylene terephthalate drawing techniques as a heating medium without regard to its capabilities to alter uniquely the physical properties of the undrawn monofilaments as disclosed herein. For example, British Pat. No. 1,266,982 employs an initial draw and a subsequent draw in superheated steam to alter the tensile and shrinkage properties of polyethylene terephthalate filaments and yarns. In a somewhat related fashion, U.S. Pat. No. 3,452,132 discloses the asymmetrical impingement of superheated steam at sonic velocities on yarns in order to "open" the yarns and obtain a rapid temperature elevation in the draw zone. In some further non-draw prior art techniques disclosed in U.S. Pat. Nos. 2,861,865 and 3,030,173, steam treatments are respectively employed to dull the fiber surface via solvent removal and to remove preorientation or random crystallization.

SUMMARY OF THE INVENTION

As previously indicated, the present invention provides a method of improving a loop tenacity and resistance to fibrillation of polyester monofilaments comprising a partial first draw of the undrawn monofilaments in a vapor medium to a draw ratio in the range of about 1.5:1 to about 4:1, and a second draw to provide a total draw ratio of from about 4:1 to about 10:1. The preferred technique involves a partial first draw in which the vapor medium contains entrained liquid in droplet form and it is radially directed onto the undrawn monofilament during the drawing thereof.

The polyesters contemplated in this invention are known crystallizable, linear polyethylene terephthalates which may include minor amounts, totaling from 1 to 20 parts by weight of the polyester of one or more different polyester materials to provide copolyesters and terpolyesters. Examples of such polyesters include polyethylene terephthalate/polyethylene isophthalate (85/15) and polyethylene terephthalate/5- (sodium sulpho) isophthalate (97/3). Generally, commercially available noncrystalline, melt spinnable polyethylene terephthalate having an intrinsic viscosity of at least 0.6 when measured in a 60/40 mixture of phenol/tetrachloroethane is a preferred starting material from which to form monofilaments for treatment in accordance herewith.

The undrawn denier of the spun monofilament is preferably in the range of from 500 to about 50,000. The filaments may have circular or acircular cross sections such as a "Y", rectangular, or ribbon-like form. The process and equipment for melt spinning such filaments are also well known.

The term "substantially noncrystalline" as used herein is intended to include "noncrystalline" as well as that minor degree of crystallinity which may, during spinning and handling immediately thereafter and prior to any drawing of the monofilament, occur spontaneously or as a result of handling or temperature changes. Generally, there is a comparatively minimum amount of preorientation and crystallization in monofilaments of the size or denier contemplated herein.

The vapor medium may comprise any suitable liquid vapor or mixtures of liquid vapors which do not physically degrade polyesters, and which can be maintained as a vapor medium at a pressure and temperature relationship within the ranges hereinafter set forth. To be effective, the liquid vapor and, more specifically, the liquid which is absorbed by the monofilament should act as a plasticizer. Examples of suitable materials include water, aliphatic alcohols such as methanol and mixtures of these materials. In addition, monofilament modifying agents may be incorporated in the vapor medium in relatively lesser amounts to achieve particular modifications of the monofilament.

As a practical and commercial consideration, live steam is typically employed as the major or sole component of the vapor medium. Accordingly, the process of the present invention is hereinafter described and illustrated with reference to the use of live steam as a vapor medium, it being understood that the use of the aforementioned liquid vapors or mixtures thereof are subject to parameters corresponding to those discussed with respect to steam. Further, the vapor medium or steam may initially be in a dry condition in the sense that entrained liquid in droplet form is not present since the vapor will condense upon contacting the relatively cool surface of the monofilament.

The steam treatment contemplated herein exposes the undrawn monofilament to live steam preferably containing at least 1% by weight entrained droplet-type water. The effective pressure range from the steam treatment is from 1 psig. to 150 psig., and the specific processing pressure is selected to optimize the loop strength of the particular monofilament being drawn. It should be appreciated that the minimum possible operating pressure merely must assure a monofilament temperature which is greater than the apparent second order transition temperature of the particular polyester. Similarly, the maximum operating pressure is such that the corresponding temperature is less than the melting point temperature of the polyester.

The residence or contact time of the monofilament in the steam treatment is generally less than 5 seconds. Although a longer residence time in the steam will also provide the desired results, a further advantage of the steam medium lies in the fact that such results are typically obtained in less than 5 seconds which is commercially quite practical. The preferable contact time resulting in the improved physical properties obtained herein is related to variables of the vapor or steam treatment, draw ratio, and the characteristics of the particular polyester monofilament being treated. As a practical matter, the linear processing speed of the monofilament is usually greater than 10 ft/min. and the selected steam pressure has a corresponding temperature in excess of 100° C.

The term draw ratio as employed herein is generally in accordance with the prior art usage of this term, and it is employed to denote the weight ratio of a unit length of the monofilament before and after drawing. In this instance, the weight ratio is approximated by the reported speed ratio of the rolls between which the monofilament is drawn.

It has been observed that the use of live steam in the drawing operation tends to facilitate the draw and permit effective drawing at somewhat lower temperatures. These observations are believed to be associated with the superior heat transfer properties of a vapor medium such as steam and a plasticizing affect by the absorbed water. The plasticizing affect of the absorbed water or similar plasticizing agents such as low molecular weight alcohols on the monofilament is considered to effectively lower the apparent second order transition temperature and permit drawing to occur at a lower temperature. As explained in greater detail hereinafter, an initial draw of this type results in a somewhat lesser degree of molecular arrangement but enables an increased amount of further molecular modification as compared with prior art techniques in a high denier, large cross sectional monofilament.

The process of the present invention may be used to advantage in either a "coupled" or a "split" process for producing polyester monofilaments. The apparatus is composed of known units arranged and utilized however, in a different manner from that commonly used in treating polyester monofilaments. Basically, the apparatus includes an extruder and liquid quench assembly, godet rolls, a steam tube or tubes such as that disclosed in British Pat. No. 1,167,696, dryers, and possibly hot air ovens or infrared ovens, and take up reels or spools.

FIG. 1 of the drawings schematically illustrates suitable apparatus for treating a monofilament in accordance with the present invention in a coupled process.

Figure 1:
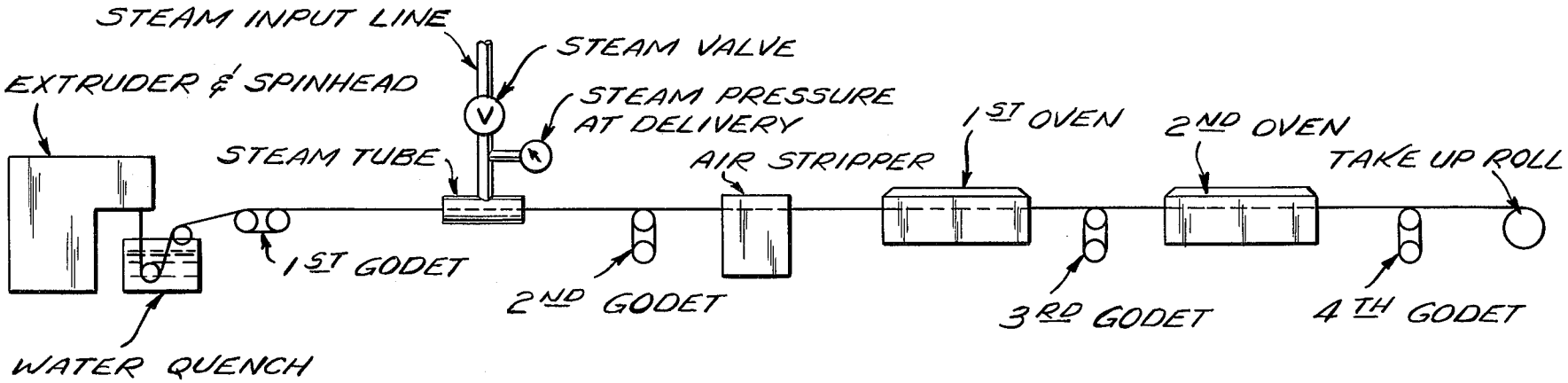

Referring to the FIG. 1, a suitable polyester is extruded and spun with conventional apparatus. As previously indicated, the monofilament formed may be of circular or acircular configuration, and it will have a relatively large cross sectional area. For example, a typical circular undrawn monofilament will have a diameter in the range of 45 to 50 mils and a rectangular undrawn monofilament may have dimensions on the order of 115 by 40 mils. It should be appreciated that prior art technology relating to low denier or smaller sized monofilaments and yarns is not readily translatable to the larger high denier monofilaments contemplated herein. This has been found to be true particularly with respect to the development of longitudinal and loop tenacity values. Consequently, high denier monofilaments have heretofore been utilized in a somewhat inefficient manner.

The spun monofilament is immediately quenched in a conventional water quench tank wherein it is trained about suitable rollers. Although the temperature of the water quench is not critical, it is usually maintained below the apparent second order transition temperature and typically at about 35° C. Upon quenching, the monofilament will have a substantially transparent appearance characteristic of an amorphous polyester.

In a discontinuous split process, the monofilament would be drawn from the water quench and wound on storage reels for subsequent processing. The orientation and/or crystallization which may occur in this processing and storage phase of the split process have been found to be of a minor degree which does not detract from the unique benefits obtained by a subsequent vapor or steam treatment of the monofilament as disclosed herein.

In the illustrated coupled or continuous process, the monofilament is guided from the water quenching tank to a first set of godet rolls. Thereafter, the monofilament passes through a steam tube and then about a second set of godet rolls which cooperate with the first set of godet rolls to draw the monofilament.

The first and second sets of godet rolls are driven at a fixed speed differential so as to result in the uniform drawing of the monofilament. In the practice of the present invention, the monofilament is drawn by the first and second sets of godet rolls to a draw ratio in the range of 1.5:1 to 4:1.

The drawing of the monofilament and, more particularly, the actual physical deformation of the monofilament between the first and second set of godet rolls occurs primarily within the steam tube. The draw or physical deformation of the monofilament within the steam tube is characterized by a gradual tapering of the filament from its undrawn dimensions to its drawn dimensions.

The gradual tapering of the monofilament is preferred over the prior art "neck point" deformation which is characterized by a sharp or abrupt reduction in the cross sectional size of the monofilament and a severe, localized working of the polymer at the neck point. The prior art neck point deformation is believed to be associated with a premature, high degree of orientation and/or crystallization adjacent the outer surface of the monofilament which tends to inhibit further molecular modification and the full development of the physical properties of the monofilament in comparison with the process of the present invention.

As previously indicated, the steam tube is of a conventional structure such as that disclosed in British Pat. No. 1,167,696. The steam tube includes entrance and exit ports at its axial ends and it has an outer jacket and a perforated core which cooperate to define an annular chamber for receiving the pressurized steam. The perforated core defines a passageway through which the monofilament passes as it is being drawn. The perforated core is provided with a plurality of perforations or steam outlets along its length and about its periphery so as to permit radially inward impingement of the steam upon the monofilament and about the entire periphery thereof regardless of the particular configuration of the monofilament. Thus, the radial impingement or direction of the vapor or steam upon the monofilament may be more aptly described as impingement at substantially right angles to the longitudinal axis of the monofilament about the entire periphery thereof.

Although the radial dimensions of the perforated core and the dimensions of the steam outlets as well as those of the entrance and exit ports are not critical, they are appropriately sized so as to result in the desired elevated temperature and pressure. Proper choice of hole size in the perforated core allows radial peripheral impingement of the steam upon the monofilament. For example, satisfactory steam impingement velocities have been obtained in the steam pressure range contemplated herein when the perforated core is provided with an inside diameter of 3/32 of an inch and the steam outlets with a diameter of about 1/16 of an inch. It should be appreciated that the steam impingement velocity is related with other process parameters, and that it may approach and approximate zero value with appropriate adjustment of other parameters such as the residence time of the monofilament within the steam tube.

The entrance and exit ports of the steam tube may be modified to accommodate a plurality of monofilaments which may be simultaneously treated within the steam tube. For example, each of the ports may be provided with multiple openings or an enlarged single opening configured to receive a number of filaments which are contiguously disposed with respect to one another.

As shown in FIG. 1, the live steam is delivered to the steam tube at a central location intermediate the entrance and exit ports of the steam tube. However, it may be preferable in some instances to offset the steam delivery to a position adjacent the entrance port. A sufficiently uniform distribution of steam is obtained throughout the length of the steam tube since the outside diameter of the steam jacket is relatively small and the overall length of the steam tube is not great. For example, acceptable steam distribution has been obtained with the steam delivery spaced four inches from the entrance port of a steam tube having an eighteen inch overall length and a steam jacket outside diameter of about one inch.

The steam pressure is regulated by means of a steam valve in the steam input line, and the steam pressure is monitored by a conventional pressure gauge disposed in the jacket of the steam tube. In instances where it is desired that the steam impinge on the surface of the monofilament, there is a pressure drop between the jacket and the steam chamber. However, the entrance and exit ports of the steam tube should not be so large that the pressure and temperature in the steam tube are too low.

As previously indicated, the draw or physical deformation of the monofilament occurs substantially within the steam tube. The temperature of the monofilament during the drawing operation is believed to approximate the condensation temperature of the steam at the selected operating pressure. The uniform maintenance of this monofilament temperature is aided by the presence of entrained water which will remove excess heat by vaporizing from the surface of the monofilament if the temperature thereof rises above the condensation temperature.

The monofilament passes from the second set of godet rolls through an air stripper or dryer which removes moisture carried on the surface of the filament without elevating the temperature thereof. Thereafter, the monofilament passes through a first oven and it is further drawn at an elevated temperature by means of the second and third set of godet rolls. This further draw is essentially a dry draw at elevated temperatures, and it is performed under conventional operating conditions. In the illustrated apparatus, the first oven is provided with infrared heat, but any conventional dry heating system may be employed.

The total aggregate filament draw is generally achieved in the steam tube and a first oven or subsequent draw. As previously indicated, the total draw ratio is in the range of 4:1 to 10:1, and about $\frac{1}{2}$ to $\frac{2}{3}$ of the total draw is in steam, the balance being provided in the subsequent draw. Preferably, the subsequent draw is at a draw ratio of at least 1.5:1 or greater. In terms of linear elongation, the monofilament is stretched in the range of 50% to 300% during the first partial draw in the steam tube, and the total aggregate draw corresponds to a total elongation in the range of 300% to 900%.

It should be appreciated that the subsequent or second draw does not have to be performed in dry heat, but may be provided in a second steam tube. The monofilaments drawn in multiple steam tubes have been found to have comparable improvements in physical properties.

Following the second draw, the monofilament passes from the third set of godet rolls through a second oven and about a fourth set of godet rolls. In the illustrated apparatus, the second oven is also a dry heating system of conventional structure. The third and fourth set of godet rolls do not provide a drawing function comparable to those previously described, but rather they are arranged to maintain a draw ratio of about 1.0:1.0. Thus, the monofilament is not exposed to drawing tensions, and the function of this treatment is to provide improved linear stability without significant change in the tenacity, loop tenacity, and other physical properties of the monofilament.

The monofilament passes from the fourth set of godet rolls to a conventional take-up roll or reel for purposes of storage.

The following examples are presented as being illustrative of the method of the present invention. The polyester employed in the monofilaments of the examples is polyethylene terephthalate having an intrinsic viscosity of 0.9 to 1.0 in a mixture of 60/40 phenol/tetrachloroethane.

The physical properties of the monofilament examples reported in Table I are illustrative of the improved physical properties resulting from a steam treatment in accordance with the present invention. The monofilaments in each of the examples were spun from the same polyethylene terephthalate polymer in a split process technique. Thereafter, each of the undrawn monofilaments was drawn under the conditions set forth. The apparatus employed is similar to that previously described and schematically shown in the drawing, but for the elimination of subsequent heat treatments following the second draw.

TABLE I

| EXAMPLE | PROCESSING VARIABLES* 1st Draw | 2nd Draw | TOTAL DRAW RATIO | DENIER | ELONG. BREAK(%) | TENACITY (g/den.) | LOOP TENACITY (g/den.) | LOOP TENACITY / TENACITY |
|---|---|---|---|---|---|---|---|---|
| 1 | Steam at 130 psig. draw ratio 3.5 | Steam at 130 psig. draw ratio 2.33 | 8.15 | 608 | 16.0 | 7.5 | 5.8 | 0.77 |
| 2 | " | Dry oven at 230° C. draw ratio 2.50 | 8.70 | 700 | 10.0 | 6.8 | 4.9 | 0.72 |
| 3 | Dry oven at 180° C. draw ratio 3.5 | Steam at 130 psig. draw ratio 1.75 | 6.13 | 1121 | 8.4 | 6.4 | 0.9 | 0.14 |
| 4 | " | Dry oven at 230° C. draw ratio 1.80 | 6.30 | 1020 | 7.4 | 7.6 | 0.5 | 0.07 |
| 5 | Steam at 130 psig. draw ratio 3.5 | Steam at 130 psig. draw ratio 2.5 | 8.75 | 610 | 11.0 | 8.1 | 5.3 | 0.65 |

*In all steam treatments, the level of entrained water in droplet form is 3% by weight.

In examples 1 and 2 of Table I, the undrawn monofilaments were initially exposed to a steam treatment while simultaneously being partially drawn and, thereafter, further drawn in a steam or dry oven technique to the total draw ratio. In contrast, the undrawn monofilaments of examples 3 and 4 were initially partially drawn in a conventional dry oven technique, and, thereafter, further drawn to the reported total draw ratio in a steam or dry oven technique.

As shown by examples 1 and 2 of Table I, the initial steam treatment of the undrawn monofilaments results in improved loop tenacity values irrespective of the subsequent draw technique employed. However, it is apparent from examples 3 and 4 that the benefits to be derived from a steam treatment cannot be obtained if the monofilament has been initially drawn in a conventional or prior art technique, such as a dry oven draw. Although the reason for the latter is not completely understood, it appears that the crystallinity resulting in an initial, conventional draw technique prohibits the subsequent attainment of a crystallinity of the degree or perfection resulting from an initial steam treatment in accordance with the present invention. In this regard, the improvements in the degree and perfection of crystallinity resulting from a steam treatment as described herein may include refinements in the quality of the crystallites per se and the quality of the relative orientation of the various crystallites which provide the monofilament with a preferred molecular arrangement or morphology.

Although a theoretical explanation is not presently known, empirical results have consistently dictated the necessity of an initial steam treatment of the undrawn monofilament in order to achieve the improved physical properties noted herein, and the inability to obtain such properties if a conventional prior art draw technique precedes the steam treatment. A consideration in the irreversibility of the draw techniques may be the premature, high degree of surface orientation and/or crystallinity associated with a first, prior art "neck point" type draw as previously described. The poor thermal conductivity of polyethylene terephthalate and the relatively less efficient heat transfer of prior art dry heat techniques in combination with the relatively large dimensions of the monofilament are believed to be contributing considerations in the undesirable results associated with a prior art "neck point" type draw.

The combined results of these factors is a molecular modification of the monofilament which is predominently limited to regions adjacent the outer surface thereof and the development of an undesirably thin shell about the periphery of the monofilament having a highly oriented and/or crystalline morphology which inhibits further molecular arrangement. An outer shell having such a morphology would be the primary load bearing portion of the monofilament and it would thereby limit the advantages to be obtained in subsequent draw techniques. In some cases, the limiting effect of the shell is exemplified by the rupture of the monofilament in subsequent drawing processes at relatively low draw ratios. The existence of such a shell is also consistent with the fibrillation observations of prior art monofilaments and, more particularly, the tendency to initially fail in tensile or flex fatigue adjacent the outer periphery of the monofilament in an irregular or "splintered-type" fracture which is immediately followed by complete failure of the monofilament at relatively low test values. The process of the present invention permits the attainment of a greater "effective" draw and the advantages associated with the same. This apparently results from the plasticizing and heating effects of the steam impinging on the surface of the filament so as to significantly increase the relaxation rate and deorientation of the molecules at the surface.

In contrast with the thin outer shell developed in prior art techniques, the process of the present invention results in a substantial amount of orientation and crystallization throughout the thickness of the monofilament. It is not presently known whether or not the morphology of the monofilament through its thickness is more aptly characterized as a uniformly varying gradient or by the provision of a relatively thick "casing" with acceptable levels of orientation and crystallization throughout the "core" of the monofilament within such casing. In any event, the process of the present invention is believed to substantially increase the degree and/or quality of preferred molecular arrangements within the monofilament in the initial steam treatment draw and to enhance the achievement of further molecular arrangement in subsequent drawing processes.

These advantages are believed to be obtained by the lowering of the apparent second order transition temperature by the plasticizing affect of the absorbed water in the steam treatment and the elimination of the prior art "shell". Consequently, it is believed that the degree of responsive molecular orientation and/or crystallization of the monofilament to the initial drawing operation is lessened in order to allow the achievement of an increase in the ultimate molecular properties obtained as reflected by improved physical properties.

As indicated above, examples 3 and 4 in Table I illustrate the inability to obtain the benefits to be derived from a steam treatment in accordance with the present invention if the monofilament has initially been drawn in a conventional or prior art technique. This has been found to be true even though the draw is optimized in subsequent processing (drawn at maximum possible draw ratios without break-failure of the monofilament during processing) as confirmed by the relatively high longitudinal tenacity properties developed. The relatively higher total draw ratios and lower drawn denier values obtained in examples 1 and 2 as compared with examples 3 and 4 are believed to be primarily a result of the higher draw ratios ultimately enabled by the initial steam draw as discussed above since the draw ratios were optimized in all cases.

In example 5 of Table I, the undrawn monofilaments were processed in a steam-steam draw operation similar to that employed in example 1. In confirmation of the improved resistance to fibrillation indicated by the physical properties reported in this example, the monofilaments of examples 4 and 5 were treated with a conventional adhesion promoting solution and embedded in rubber stock which was subsequently cured. The adhesion or bond between the monofilaments and rubber stock was found to be of comparable values.

In order to demonstrate the fibrillation characteristics of the monofilaments, they were stripped from the cured rubber stock in a "pull-out" test wherein significant shear forces are applied to the monofilaments. The monofilaments of example 5 stripped cleanly from the rubber stock at relatively consistent test values without evidence of fibrillation or peripherally localized irregular failures of the monofilament. In contrast, the monofilaments of example 4 displayed severe fibrillations characterized by irregular, local fracture about the pheriphery and along the length of the monofilaments as they were stripped from the rubber stock. In a commercial application such as tire reinforcing members, the occurrence of fibrillation is highly undersirable since it may result in premature failure of the monofilament or a sudden failure of an initially fibrillated and weakened monofilament which is exposed to a loading it would otherwise bear.

The results of further studies illustrating the relationship between the ratio of loop tenacity to tenacity and fibrallation resistance are reported in Table II. In this study, polyethylene terephthalate monofilaments having a circular cross section were initially subjected to a steam treatment in accordance with the present invention at various steam pressures. In addition, examples 4 through 6 of Table II were exposed to a second dry oven treatment wherein the draw ratio was essentially maintained at a value of 1.0:1.0 for purposes of improving the linear stability of the monofilament.

TABLE II

| Example | 1st Draw | 2nd Draw | 3rd Draw | Steam Pressure | Total Draw Ratio | Denier | Tenacity (g/den) | Loop Tenacity (g/den) | (Loop Tenacity) / Tenacity | Fibrillation (%)* 1 Hr. | Fibrillation (%)* 4 Hr. |
|---|---|---|---|---|---|---|---|---|---|---|---|
| 1 | Steam draw ratio 3.06 Dwell 2.3 Sec. | Dry Oven at 995° F. draw ratio 2.44 Dwell 1.6 Sec. | — | 4 psig. | 7.5 | 2178 | 7.5 | 0.9 | 0.12 | 16.7 | 50.0 |
| 2 | " | " | — | 13.5 psig. | 7.5 | 2675 | 5.6 | 0.7 | 0.13 | 33.3 | 50.0 |
| 3 | " | " | — | 20.5 psig. | 7.5 | 2650 | 4.1 | 2.5 | 0.61 | 0.0 | 0.0 |
| 4 | " | Dry Oven at 1000° F. draw ratio 2.44 Dwell 1.6 Sec. | Dry Oven at 745° F. draw ratio 0.96 Dwell 3.2 Sec. | 17 psig. | 7.2 | 2215 | 6.3 | 2.7 | 0.43 | 0.0 | 0.0 |
| 5 | " | " | " | 8 psig. | 7.2 | 2704 | 10.4 | 3.9 | 0.38 | 16.7 | 33.3 |
| 6 | " | " | Dry Oven at 745° F. draw ratio 0.98 Dwell 3.2 Sec. | 8 psig. | 7.3 | 2346 | 10.8 | 4.5 | 0.42 | 0.0 | 16.7 |

*Fibrillation tendency estimated by determining the number of tensile breaks at 75° F. showing fibrillated or irregular fracture. The percentage of such fibrillated samples is reported for two different aging periods at 205° C.

In Table II, the tendency for fibrillation to occur was promoted by aging the samples at 205° C. As shown by the results in Table II, an increase in the tenacity ratios results in a corresponding increase in the resistance to fibrillation. There appears to be a minimum tenacity ratio value in the range of about 0.2 to about 0.3 which provides significantly improved fibrillation resistance. However, it should be appreciated that the absolute value of the loop tenacity may be an equally important consideration depending upon the end use of the monofilament. For example, when the monofilaments are intended for use as reinforcing elements in tires, it is desirable to maintain the loop tenacity value above 2.5 grams per denier.

The examples of Table III are illustrative of suitable monofilaments for purposes of tire reinforcement. Each of the examples of Table III comprise a polyethylene terephthalate monofilament, example 1 illustrating a circular cross sectional monofilament and example 2 illustrating a rectangular acircular monofilament. Each of the examples was initially exposed to a steam treatment wherein a partial draw occurred, and thereafter drawn to an aggregate total draw in a dry oven technique. In addition, each of the examples was also exposed to a third oven draw wherein the draw ratio was maintained at about 1.0:1.0 for purposes of linear stability.

TABLE IV

| Ex. | 1st Draw | 2nd Draw | 3rd Draw | Total Draw Ratio | Denier | Elong. At Break (%) | Tenacity (g/den.) | Loop Tenacity (g/den.) |
|---|---|---|---|---|---|---|---|---|
| 1 | Steam at 5–50 psig Draw Ratio 5.50 Dwell 1–3 sec. 3% entrained water | Dry oven at 1095° F Draw Ratio 1.03 | | 5.7 | 2790 | 11.0 | 5.5 | 1.2 |
| 2 | Steam at 5–50 psig Draw Ratio 5.50 Dwell 1–3 sec. 3% entrained water | Dry oven at 1095° F Draw Ratio 1.03 | | 5.7 | 2700 | 7.0 | 6.7 | 4.6 |
| 3 | Steam at 5–50 psig Draw Ratio 3.75 Dwell 1–3 sec. 3% entrained water | Dry oven at 1095° F Draw Ratio 1.71 | | 6.4 | 2820 | 7.3 | 7.2 | 3.5 |
| 4 | Steam at 20 psig Draw Ratio 5.00 Dwell 1–2 sec. 3% entrained water | Dry oven at 880° F Draw Ratio 1.05 | Steam at 42 psig Draw Ratio 1.19 Dwell ~ 0.6 sec. Entrained water ≧ 3% | 6.3 | 4907 | 6.0 | 5.5 | 0.8 |
| 5 | Steam at 14 psig Draw Ratio 3.20 Dwell 1–2 sec. 3% entrained water | Dry oven at 880° F Draw Ratio 2.62 | Steam at 40 psig Draw Ratio 0.99 Dwell ~ 0.6 sec. Entrained water ≧ 3% | 8.3 | 3800 | 12.0 | 6.6 | 3.3 |
| 6 | Steam at 15 psig Draw Ratio 3.20 Dwell 1–2 sec. 3% entrained water | Dry oven at 880° F Draw Ratio 2.66 Dwell 2–3 sec. | | 8.5 | 3670 | 13.0 | 7.1 | 3.2 |

TABLE III

| EXAMPLE | 1st DRAW | 2nd DRAW | 3rd DRAW | DRAWN SIZE (mils) | ELONG AT BREAK (%) | TENACITY (g/den.) | LOOP TENACITY (g/den.) | LOOP TENACITY / TENACITY |
|---|---|---|---|---|---|---|---|---|
| 1 | Steam at 17–18 psig. draw ratio 3.6 Dwell 2.5 Sec. 3% entrained water | Dry Oven at 1000° F. draw ratio 2.2 Dwell 1.6 Sec. | Dry oven at 740° F. draw ratio 0.97 Dwell 3.3 Sec. | 20[1] | 11–12 | 10.4 | 4.6 | 0.43 |
| 2 | Steam at 7–8 psig. draw ratio 3.7 Dwell 1.7 Sec. 3% entrained water | Dry oven at 888° F. draw ratio 2.4 Dwell 2.3 Sec. | Dry oven at 720° F. draw ratio 0.99 Dwell 4.7 Sec. | 14 × 40[2] | 8–9 | 8.8 | 3.1 | 0.35 |

[1]Denier value approximately 2400
[2]Denier value approximately 3500

As reported in Table III, loop tenacity values in excess of 2.5 grams per denier were obtained and the values of the tenacity ratios were in the range which has been found to provide improved fibrillation resistance. In addition, the longitudinal tenacity values were sufficiently improved to render the monofilaments well suited for tire reinforcement applications.

Referring to Table IV, the first stage or steam draw ratio is evaluated at relatively high maximized (e.g. draw ratios on the order of 5.0:1 and higher) values which effectively result in single stage processing. The use of such maximized draw techniques in the first stage steam draw have not been found to provide the benefits of the present invention as indicated by the reported tests.

Referring to Table V, a number of further studies evaluating various processing conditions of polyethylene terephthalate monofilaments are reported. For purposes of convenience, the studies A through H have been summarized as to processing conditions and physical properties. The pertinent first stage draw parameters are characterized by this series of studies, and the necessity of effective two stage drawing in accordance with the present invention is again demonstrated.

TABLE V

| Study | 1st Draw | 2nd Draw | Total Draw Ratio[1] | Denier | Elong. At Break (%) | Tenacity (g/den.) | Loop Tenacity (g/den.) |
|---|---|---|---|---|---|---|---|
| A (4 samples) | Steam at ~ 11 psig Draw Ratio 4.37 to | Dry Oven at 905° F | ~ 6.4 | 2850 to 3210 | — | — | 0.8 to 1.5 |

TABLE V-continued

| Study | 1st Draw | 2nd Draw | Total Draw Ratio[1] | Denier | Elong. At Break (%) | Tenacity (g/den.) | Loop Tenacity (g/den.) |
|---|---|---|---|---|---|---|---|
| | 4.50 | Draw Ratio 1.42 to 1.49 | | | | | |
| B (2 samples) | Steam at ~ 11 psig Draw Ratio 4.46 | Dry Oven at 905° F Draw Ratio 1.45 | ~ 6.5 | 3220 to 3500 | — | 6.3 to 7.1 | 0.8 to 1.0 |
| C (5 samples) | Steam at ~ 11 psig Draw Ratio 4.6 | Dry Oven at 905° | ~ 6.5 | | | | |
| H | 2848 to | 4.8 to Draw Ratio 1.42 | 4.6 to | 0.4 to 3044 | 10.0 | 7.0 | 0.9 |
| D (4 samples) | Steam at ~ 14 psig Draw Ratio 4.5 | Dry Oven at 915° F Draw Ratio 1.48 | ~ 6.7 | 3007 to 3435 | 7.0 to 23.0 | 5.4 to 6.6 | 0.5 to 0.7 |
| E (3 samples) | Steam at ~ 12 psig Draw Ratio 2.12 to 3.54 | Dry Oven at 910 to 985° F Draw Ratio 2.13 to 3.70 | ~ 7.5 to ~ 7.8 | 2413 to 2950 | 12.0 to 17.0 | 6.3 to 8.3 | 0.6 to 2.5 |
| F (2 samples) | Steam ~ 12 psig Draw Ratio 2.67 to 3.69 | Dry Oven at 945° F Draw Ratio 2.02 to 2.79 | ~ 7.5 | ~ 2530 | ~ 10 | 6.3 to 6.6 | 4.8 to 5.4 |
| G (12 samples) | Steam at 5 to 23 psig Draw Ratio 2.55 to 4.5 | Dry Oven at 100° F Draw Ratio 1.34 to 3.16 | ~ 5.8 to ~ 9.2 | 1615 to 3632 | 4.4 to 13.2 | 4.2 to 10.6 | 0.5 to 3.9 |
| H[2] (9 samples) | Steam at 15 to 22 psig Draw Ratio 3.2 to 3.3 | Dry Oven at 875 to 880° F Draw Ratio 2.67 to 3.03 | ~ 8.0 to ~ 10.0 | 3060 to 3569 | 9.7 to 16.1 | 6.3 to 7.5 | 3.2 to 4.1 |

[1]Third stage drawing treatments have been omitted for purposes of convenience since they primarily provide linear stability and they do not involve significant draw ratios.
[2]The processing conditions and results in this study are as indicated except for a single sample reported above in Table IV as Example 4.

As shown by the foregoing studies, the first stage steam draw ratio is preferably limited to a maximum value of about 4.0:1 in order to obtain the benefits of the present invention and improved loop tenacity strength. (In studies E and G, the specific samples having improved loop strength were stream drawn at draw ratios less than 4.0:1.) Moreover, at steam draw ratios greater than about 4.0:1, the processing is unstable and the physical properties of the monofilaments become less uniform and rather erratic. Further, the subsequent drawing of the monofilament should preferably be at a draw ratio of at least 1.5:1 in order to assure effective two stage processing and the attainment of the advantages of the present invention.

In the practice of the subject invention, drawing parameters such as steam pressure and draw ratio are optimized or controlled, in accordance with known techniques for purposes of assuring the development of the maximum or desired loop strength of the particular monofilament being processed. The optimization or control of steam pressure and draw ratio within the practice of the subject process is illustrated by the designed experiments reported in Table IV for two different size polyethylene terephthate monofilaments and resulting contour plots shown in FIGS. 2 to 5.

The particular designed experiment used is a two factor, pentagonal design requiring six data points for each dependent variable examined. The processing conditions and tenacity values for a 50 mil-round, undrawn monofilament are reported in Table VI as examples 1 to 6, and the corresponding conditions and values for a 40 mil-round, undrawn monofilament are reported as examples 7 to 12. In each of the designed experiments, the processing variables, except for the independent variables being examined, were maintained constant as reported. The first stage draw ratio and steam pressure were varied as independent variables, and the reported tenacity properties were obtained after an optimized second stage oven draw.

Figure 3:
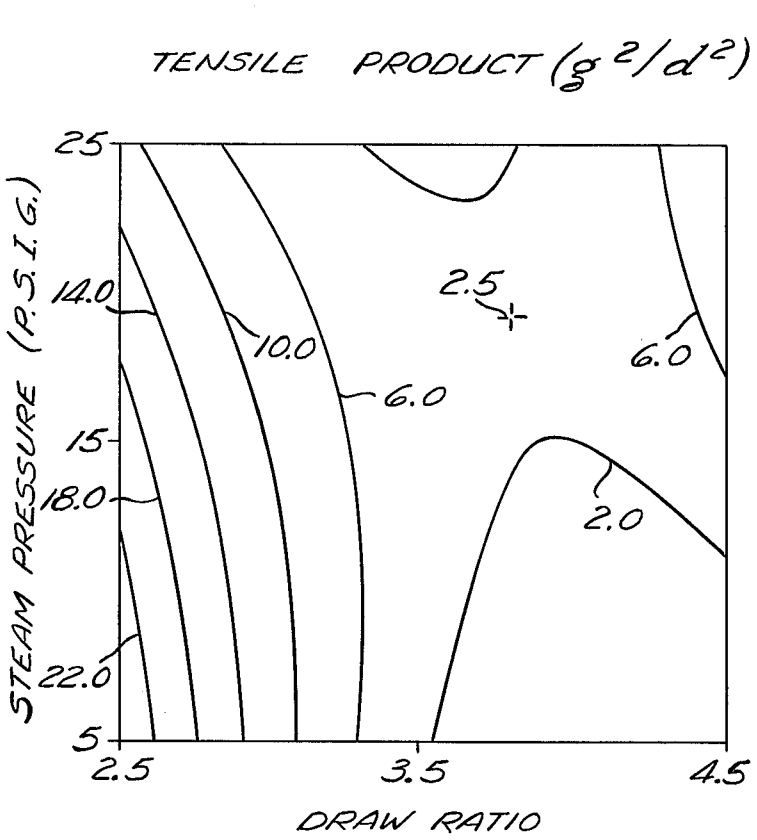
FIG. 3 is a contour plot similar to FIG. 2, but showing the product of the longitudinal loop tenacity values.
Figure 2:
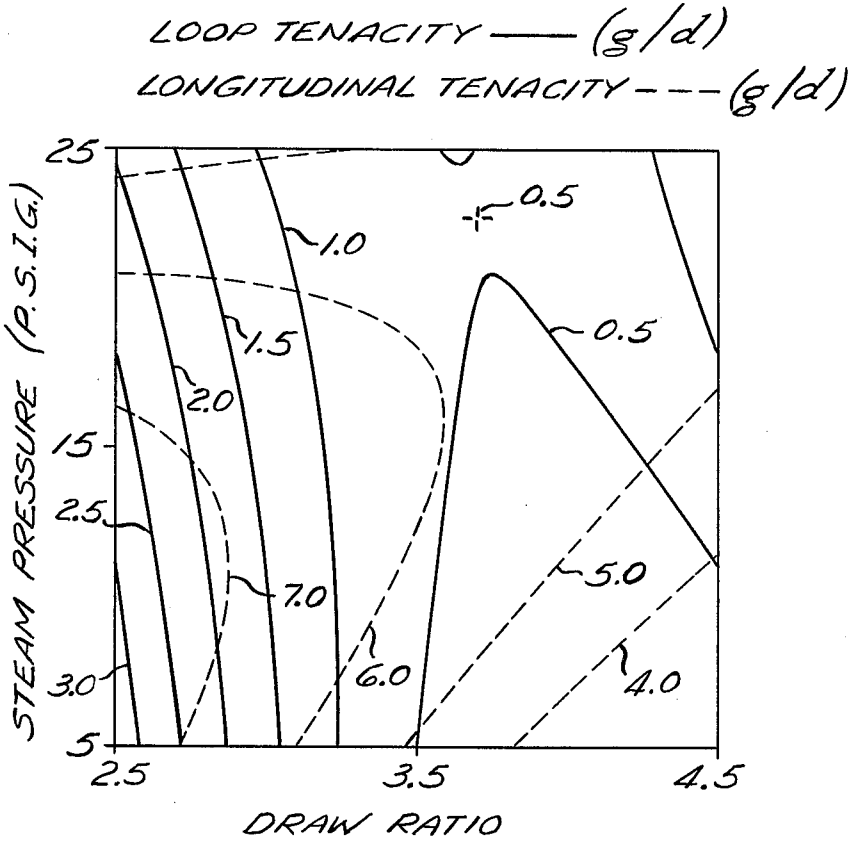
FIG. 2 is a contour plot obtained through designed experiments showing tenacity values as a function of varying first stage steam pressure and draw ratio conditions for a 50 mil-round, undrawn monofilament, the longitudinal and loop tenacity values being imposed upon one another for convenience of illustration.
Figure 5:
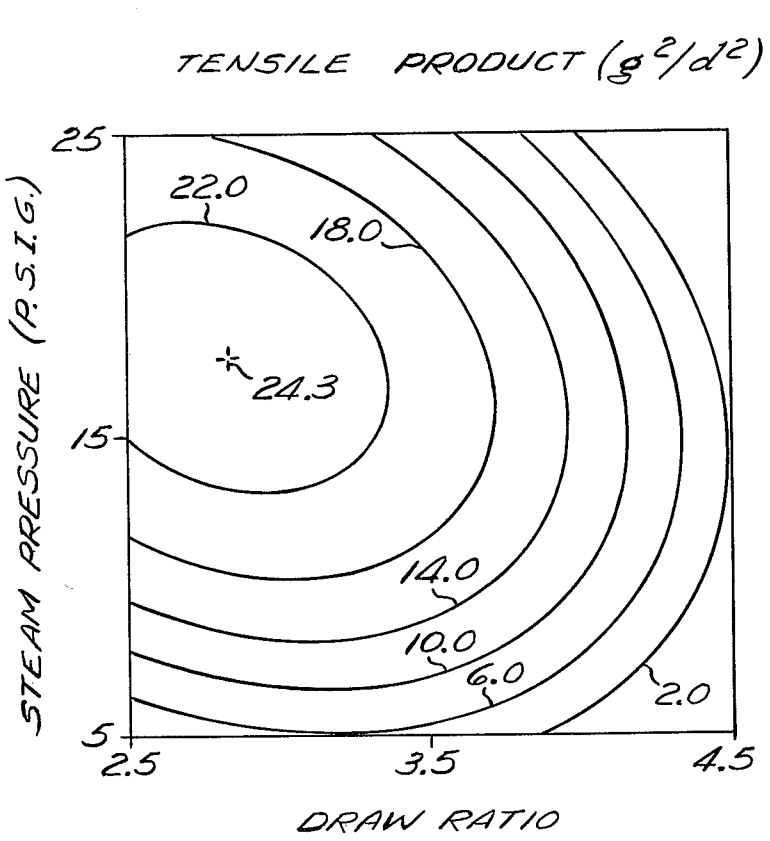
FIGS. 4 and 5 are contour plots similar to FIGS. 2 and 3, respectively, but for a 40 mil-round, undrawn monofilament.
Figure 4:
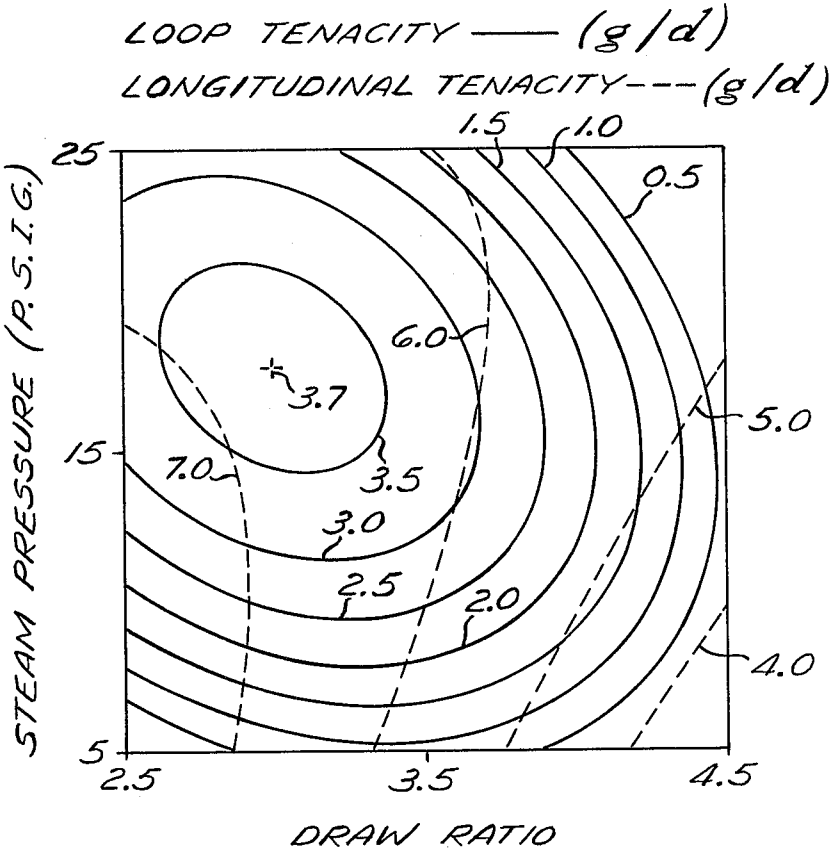

In FIGS. 2 and 4, the contour plots of the longitudinal tenacity and the loop tenacity have been imposed upon one another for convenience of illustration. In FIGS. 3 and 5, the contour plots of the product of the longitudinal and loop tenacity values (tensile product in grams$^2$/denier$^2$) are respectively depicted for the designed experiments of FIGS. 2 and 4. In all of the figures, only a portion of the contour plot between pertinent draw ratio values and steam pressure values is shown.

TABLE VI

| Example | Draw Ratio Steam | Draw Ratio Oven[1] | Draw Ratio Total | Contact Time (Sec.) Steam | Contact Time (Sec.) Oven | Steam Pressure | Denier | Tenacity (g/den) | Loop Tenacity (g/den) |
|---|---|---|---|---|---|---|---|---|---|
| 1 | 4.00 | 1.50 | 6.0 | 1.5–2.7[2] | 1.3–2.0[3] | 23 psig | 3520 | 5.4 | 0.7 |
| 2 | 4.50 | 1.34 | 6.0 | " | " | 12 psig | 3506 | 4.2 | 0.5 |
| 3 | 3.50 | 1.81 | 6.3 | " | " | 5 psig | 3317 | 4.9 | 0.5 |
| 4 | 2.55 | 3.14 | 8.0 | " | " | 12 psig | 2650 | 7.5 | 2.8 |
| 5 | 2.91 | 3.16 | 9.2 | " | " | 23 psig | 2264 | 5.4 | 1.2 |
| 6 | 3.50 | 1.71 | 6.0 | " | " | 15 psig | 3632 | 6.1 | 0.6 |
| 7 | 4.09 | 1.41 | 5.8 | 1.1–1.9[2] | 0.9–1.4[3] | 23 psig | 2434 | 5.7 | 0.7 |
| 8 | 4.45 | 1.41 | 6.3 | " | " | 12 psig | 2280 | 4.4 | 0.5 |
| 9 | 3.50 | 1.65 | 5.8 | " | " | 5 psig | 2463 | 5.6 | 0.9 |
| 10 | 2.55 | 3.12 | 8.0 | " | " | 12 psig | 1825 | 7.5 | 2.5 |
| 11 | 2.91 | 3.05 | 8.9 | " | " | 23 psig | 1615 | 6.4 | 3.2 |
| 12 | 3.50 | 2.38 | 8.3 | " | " | 15 psig | 1830 | 6.2 | 3.3 |

[1]Oven temperature -1005° F. to 1025° F.
[2]Based on speed of monofilament as it exits from steam tube.
[3]Based on speed of monofilament as it exits from oven.

The optimized processing of the particular monofilament of example 1 to 6 of Table VI is readily apparent from FIGS. 2 and 3. In this instance, the first stage draw ratio and steam pressure should be maintained at relatively low values in order to maximize the tenacity properties and assure a loop tenacity value of 2.5 grams per denier or greater. In the same manner, FIGS. 4 and 5 are employed to optimize the parameters of the first stage draw in the processing of the particular 40 mil monofilament of examples 7 to 12 of Table VI.

The optimization of the specific drawing conditions within the processing parameters of the subject process may be achieved by known techniques other than the use of the described designed experiments. The particular technique employed need only enable determination of the effects of conventional drawing parameters so as to permit the full realization of the improvements in accordance with the present invention.

The effects of the conventional drawing parameters are related to one another in the optimization process for the particular monofilament to be processed and, for example, the specific draw ratio and system pressure are determined so as to provide the desired properties. Generally, the vapor or steam pressure is controlled within the draw ratios of the subject process to accommodate the particular monofilament being processed and provide the desired tenacity properties.

What is claimed is:

1. The method of improving the loop strength and resistance to fibrillation of a polyethylene terephthalate monofilament which comprises the sequential steps of:

(a) passing, prior to any previous orientation drawing thereof, an extensible spun linear polyethylene terephthalate monofilament having an instrinsic viscosity of at least 0.6 and having a denier in the range of from 500 to 50,000 through an elongated chamber;

(b) exposing the monofilament to a vapor medium at an elevated temperature and pressure within said chamber whereby the temperature of said monofilament is raised above the apparent second order transition temperature, but below the apparent melt temperature of the particular polyethylene terephthalate;

(c) drawing the monofilament in a first drawing operation while exposed to said vapor medium at a draw ratio of from 1.5:1 to 4:1 and controlling the pressure of said vapor medium to optimize the loop strength of the monofilament; and (d) further drawing the monofilament in a subsequent drawing operation to an aggregate draw ratio of from 4:1 to 10:1 and, thereby increasing the loop strength of the monofilament to at least 2.5 grams/denier.

2. The method of claim 1 wherein said monofilament enters said chamber at a temperature lower than that of said vapor medium and said vapor medium partially condenses on the surface of said monofilament.

3. The method of claim 1 wherein said vapor medium is radially inwardly directed onto the surface of said monofilament within said chamber.

4. The method of claim 1 wherein the subsequent drawing operation is done while the monofilament is heated to a temperature of at least 80° C in dry heat.

5. The method of claim 1 wherein the subsequent drawing operation is done while exposing the monofilament to a vapor medium at an elevated temperature and pressure.

6. The method of claim 1 wherein said vapor medium contains at least 1% by weight entrained droplet-type liquid.

7. The method of claim 1 wherein said vapor medium is live steam containing at least 1% by weight entrained water in droplet form.

8. The method of claim 7 wherein said monofilament is exposed to said live steam at a pressure of from 1 psig. to 150 psig. in said first drawing operation.

9. The method of claim 8 wherein said monofilament is exposed within said elongated chamber for a period of less than 5 seconds.

10. The method of improving the loop strength and resistance to fibrillation of a high denier polyethylene terephthalate monofilament which comprises the sequential steps of:

(a) passing, prior to any previous orientation drawing thereof, a spun linear polyethylene terephthalate monofilament having an intrinsic viscosity of at least 0.6 and having a denier in the range of from 500 to 50,000 through a vapor medium containing entrained water in droplet form at an elevated temperature;

(b) impinging said vapor medium onto the surface of said monofilament at substantially right angles to the longitudinal axis of the monofilament whereby the temperature of said monofilament is raised above the apparent second order transition temperature, but below the apparent melt temperature of the particular polyethylene terephthalate;

(c) drawing the monofilament in a first drawing operation by gradually tapering and deforming said monofilament from its undrawn dimensions to its drawn dimensions in a draw ratio of from 1.5:1 to 4:1 while exposed to said vapor medium at a predetermined pressure to optimize loop strength; and (d) further drawing the monofilament in a subsequent drawing operation to an aggregate draw ratio of from 4:1 to 10:1, and thereby increasing the loop strength of the monofilament to at least 2.5 grams/denier.

11. The method of improving the loop strength and resistance to fibrillation of a polyethylene terephthalate monofilament which comprises the sequential steps of:

(a) passing, prior to any previous orientation drawing thereof, an extensible spun linear polyethylene terephthalate monofilament having a intrinsic viscosity of at least 0.6 and having a denier in the range of from 500 to 50,000 through an elongated chamber;

(b) exposing the monofilament to a steam medium at an elevated temperature and pressure within said chamber whereby the temperature of said monofilament is raised above the apparent second order transition temperature, but below the apparent melt temperature of the particular polyethylene terephthalate;

(c) drawing the monofilament in a first drawing operation while exposed to said steam medium at a draw ratio of from 1.5:1 to 4:1 and at a predetermined steam pressure to optimize loop strength; and (d) further drawing of the monofilament in a subsequent drawing operation at a draw ratio of at least 1.5:1 and to an aggregate draw ratio of from 4:1 to 10:1 to enable the monofilament to be provided with a loop strength of at least 2.5 grams/denier.

* * * * *